United States Patent [19]

Gross

[11] 4,010,589

[45] Mar. 8, 1977

[54] PANEL MOUNTING

[75] Inventor: Charles Fleming Gross, Montreal, Canada

[73] Assignee: Domtar Limited, Montreal, Canada

[22] Filed: Nov. 3, 1975

[21] Appl. No.: 628,336

[30] Foreign Application Priority Data

July 18, 1975 Canada ..... 231797

[52] U.S. Cl. ..... 52/483; 52/492

[51] Int. Cl.[2] ..... E04B 5/52

[58] Field of Search ..... 52/492, 511, 509, 582, 52/483, 281, 460, 241, 481, 493

[56] References Cited

UNITED STATES PATENTS

| | | | |
|---|---|---|---|
| 3,429,090 | 2/1969 | Metelnick | 52/481 |
| 3,852,927 | 12/1974 | Birum, Jr. | 52/483 X |

*Primary Examiner*—Price C. Faw, Jr.
*Assistant Examiner*—Carl D. Friedman
*Attorney, Agent, or Firm*—C. A. Rowley

[57] ABSTRACT

The present invention relates to a system for mounting panels on studs and which permits automatic positioning of the studs as the panels are erected. The system incorporates pairs of clips mounted on adjacent panels, a first set of clips on one panel engages one side of a stud and a second set of clips on an adjacent panel resiliently locks with the other side of the stud and forces the stud into position engaging flanges on the first set of clips thereby positioning the stud. The first set of clips have forwardly projecting portions that underly the adjacent panels on which the second set of clips is mounted whereby the adjacent margins of both panels are held to the stud.

7 Claims, 5 Drawing Figures

PANEL MOUNTING

FIELD OF THE INVENTION

The present invention relates to a method of mounting wall panels. More specifically the present invention relates to a clip system for securing wall panels to studs.

DESCRIPTION OF THE PRIOR ART

Numerous systems have been proposed for connecting wall panels particularly pre-finished panels to metal studs to provide easily dismantled partition structures for use in office building and the like. Generally in such construction a frame, consisting of ceiling and floor runners secured in position with a plurality of metal studs extending between and secured to these floors and ceiling runners is provided. The panels are then positioned relative to the floor and ceiling runners and to the studs and some form of securing mechanism is provided to anchor the panels to the studs. If the joints are to be covered battens are used to secure the panels directly to the stud and to cover the joints. Many of these securing systems require access to the face of the stud in order to secure the panel to the stud. It will also be apparent that accurate alignment between the studs and the side edges of the panels is essential.

It has been proposed to use simple clip structures wherein a flange projects from one element and is positioned face to face with the supporting structure (stud) and is overlapped by the margin of the adjacent panel and this adjacent panel is clipped or otherwise secured to the stud to hold both the panels in position, see, for example, Canadian Pat. No. 453,69 issued Feb. 21, 1894 and Canadian Pat. No. 487,867 issued Nov. 11, 1952 to Desauriers and Wynmalen etal. The earlier patent discloses a wall structure wherein metal members having decorative surfaces are secured to angle bars in the manner described above, i.e a plate extends from one member, is positioned in face to face relationship with the angle bar and is overlapped by the adjacent edge of the next member which is secured to the angle bar by a curled back flange. The later patent is similar to the earlier patent with the exception that the projecting flange from the first member also hooks around the stud or supporting member on the same side of the stud as the next member.

It will be noted that in neither of the two systems is contact made by the clips on the adjacent panels on each side of the stud thus the stud must be properly positioned before the panels can be erected.

SUMMARY OF THE PRESENT INVENTION

It is an object of the present invention to provide a clip system for securing panels to conventional metal studs or other structural members.

Broadly the present invention relates to a system for securing panels to structural members comprising first clip means connected to a rear face of one panel at one marginal edge thereof, said first clip means comprising a substantially flat plate with flange means projecting substantially perpendicular therefrom, means for securing said first clip to said one panel with said flange means projecting rearwardly from said panel and with a portion of said plate projecting laterally from said one edge of said panel, said flange means engaging one side of said structural member, an adjacent panel, second clips means secured to the rear face of said adjacent panel of said second clip means comprising a plate element, means for connecting said element to said adjacent panel, resilient locking means projecting from said element rearwardly relative to said adjacent panel and in a position to cooperate with cooperating means at the side of said structural member remote from said one side, said adjacent panel having its margin overlying said laterally extending portion of said plate.

The first flange means and the locking means engage opposite sides of the structural member or stud and function to position the studs thereby facilitating erection of the wall. In constructing a wall floor and ceiling runners and a first stud or suitable starting member are erected and the first panel is mounted on this stud by engaging the resilient locking member with the flanges of the stud. Next a second stud is erected between the floor and ceiling runners and is forced against the flanges of the first clip means which are positioned along the adjacent marginal edge of the panel and engagement between the face of the stud and the flanges, thereby accurately positioning the stud relative to the panel. The next panel is then erected by moving it towards the first erected panel so that the resilient locking members on the next panel engage the stud with the marginal edge of next panel overlying thereby laterally trapping projecting portions of the clips on the first panel against the face of the stud to securing the first panel and the adjacent edge of the second panel in position. This procedure is repeated for the length of the wall.

BRIEF DESCRIPTION OF DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 4:
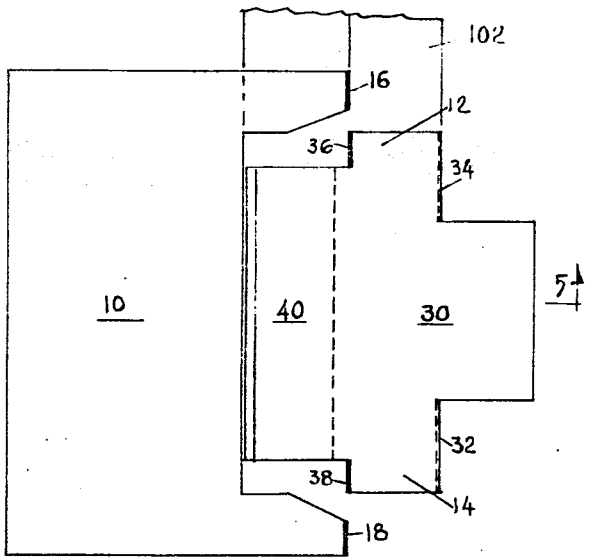
FIG. 4 is a section along the line 4—4 of FIG. 3 illustrating one mode of relatively positioning the clip means.

The second clip 10 of the present invention comprises a substantially flat plate element 11 preferably having a pair of forwardly extending arms 12 and 14 which are curled up at their free ends to provide positioning flanges 16 and 18 to facilitate positioning of the clip on the panel. A resilient locking member 20 is positioned between the arms 12 and 14 and extends rearwardly from the plate 11 (i.e. in the opposited direction of the positioning flanges 16 and 18). This resilient locking member 20 is provided adjacent its free end with an upturned flange 22 and a depressed locking section 24 but any suitable shaped locking member may be used.

The face of the element 10 which is to be secured to the panel may be provided with a coating of pressure sensitive adhesive indicated by line 26 covered by a suitable stripable release sheet generally indicated at 28 which is removed to expose the adhesive 26 for application to the panel. Alternatively the element 10 may be connected to the panel by any suitable means for example by contact cement or mechanical fastening means penetrating the panel.

Figure 2:
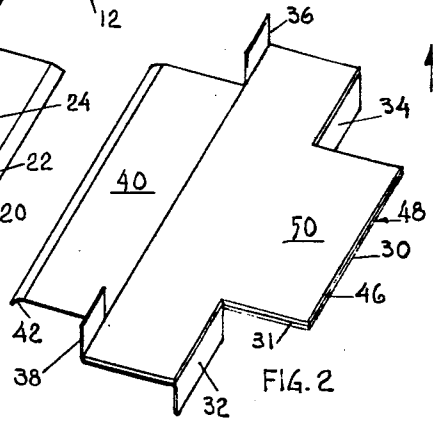
FIG. 2 is an isometric view of the first clip means of the present invention.
Figure 1:
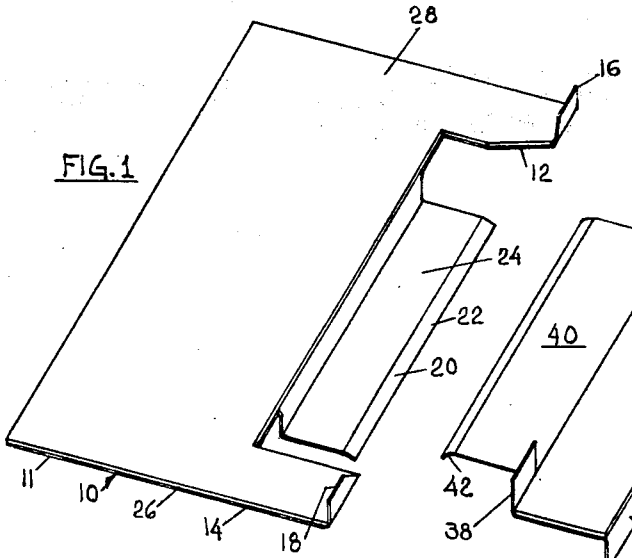
FIG. 1 is a isometric view of the second clip means of the present invention.

The first clip 30 of the present invention is shown in FIG. 2. This clip 30 comprises a plate 31 having a pair of flanges 32 and 34 extending substantially perpendicularly therefrom in one direction and one or more positioning flanges 36 and 38 forward of the flanges 32 and 34 and extending substantially in the opposite direction from the clips 30. The flanges 32, 34 and 36, 38 are substantially parallel to each other and the pair of flanges 32 and 34 and The pair of flanges 36 and 38 are in substantially the same plane. A portion of the plate 31 formed in the illustrated arrangement by an element 40 provides an extension of the plate 30 on between the flanges 36 and 38. This 40 preferably is slightly curled at its free end as indicated at 42 to cooperate with the shape of the stud. If single positioning flange is provided preferably in the middle of the clip the element 40 will be divided into a pair of elements spared by the flange. The face of the clip 30 facing in the direction of projection of the flanges 36 and 38 may be provided with a coating of pressure sensitive adhesive 46 between the rear edge 48 of the clip 30 and the flanges 36 and 38 and covered by stripable release sheet to substantially equivalent to the release sheet 28 of the second clip 10. Alternatively other suitable securing means for example as described above with respect to the chip 10 may be used.

The clips 10 are positioned on the panels by abutting the flanges 16 and 18 against one side edge of the panel thereby to accurately position the locking element 20, pressing the clip 10 against the rear face of the panel whereby the adhesive 26 secures the clip to the panel. The clip 30 is positioned by the flanges 36 and 38 abutting the opposite lateral free edge of the panel with the adhesive 46 securing the clip 30 to the back face of the panel so that the flanges 32 and 34 project rearwardly of the panel and the forwardly extending element 40 extend outwardly beyond the side edge of the panel.

Figure 3:
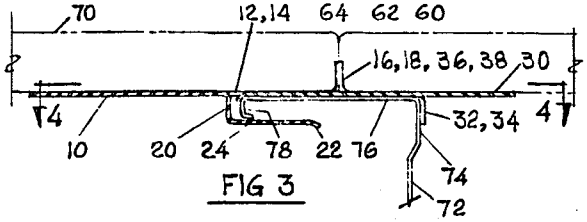
FIG. 3 is a horizontal section to a stud illustrating the connection between the two clip means and the stud.

Referring to FIG. 3 panels 60 and 70 are shown secured to a stud 72 which has lateral face 74 on one side and a flange 76 provided with a turned over free edge 78 on the other side. It will be apparent that each panel will have normally a set of clips 10 along one marginal edge and a second set of clips 30 along its opposite marginal edge.

The clips 30 with the flanges 36 contacting the edge 62 of panel 60 are connected to the panel 60 and the side face 74 of the stud 72 is positioned in abutting relationship with the flanges 32 and 34 of the clips 30.

The clips 10 on the other hand are secured to the rear face of the panel 70 with their positioning flanges 16 and 18 contacting the lateral edge 64 of the panel 70. The resilient locking elements 20 snap over the turned edge 78 of the flange 76 of the stud 72 so that the turned edge 78 is received within the depression 24. The turned edge 22 of the locking element 20 provides a cam surface to facilitate mounting the locking element 20 over the flange 78 so that the flange 78 is received in the depression 24.

The number of clips per panel and the position of the clips may vary depending on the height and weight of the panels etc., however it is preferred that there by at least 3 clips along each marginal edge of the panels with one of the clips adjacent the center of the panel.

Figure 5:
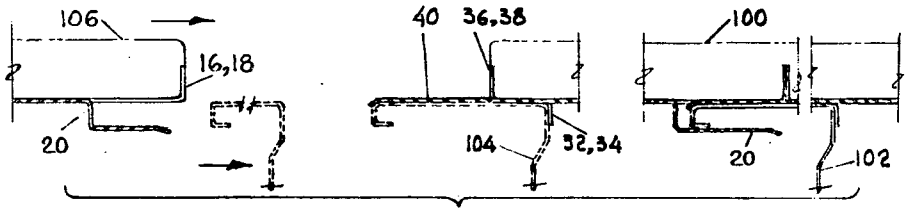
FIG. 5 is a section on lines 5—5 of FIG. 4 on a reduced scale and illustrating how the wall is erected.

The method of erection will be apparent in FIG. 5. First the panel, say panel 100, is secured in position on an erected stud 102, by snapping the locking elements 20 at one end of the panel 100 over the flanges of the erected stud 102 and the panel is positioned in the plain of the wall. A second stud 104 is then laid into position against the flanges 32 and 34 of the clips 30 on the opposite end of the panel 100 with the forwarding projecting element 40 in face to face relationship with the face of the stud 104. The next panel 106 is then laid into position with the locking element 20 clipping over the flange of the stud 104 and with the free edge 106 of the panel 102 overlying the projecting element 40 of the clip 30 on the panel 100. The above procedure is repeated for the length of the wall.

It will be noted in FIG. 4 that the clips 10 and 30 are of such a relative size that they can be mounted on opposite sides of the panels so that the clip 30 is received between the arms 12 and 14 of the clip 10. This relationship of the clips is not essential to the operation, the clip 10 may be mounted above or below the clip 30 as desired but clips on a adjacent panels cooperating with the same stud should be close together to insure proper locking.

Modifications will be evident to those skilled in the art without departing from the spirit of the invention as defined in the appended claims.

I claim:

1. A system for securing panels to structural members comprising a first panel, a plurality of discrete first clip means, each having a substantially flat plate with flange means projecting substantially perpendicularly therefrom, means for securing a plurality of said first clip means in spaced relationship to said first panel with said flange means projecting from one face of said first panel, said plate in face to face relationship with said one face and with a portion of said plate projecting laterally beyond one side edge of said first panel, said flange means engaging one side of one of said structural members, an adjacent panel, a plurality of discrete second clip means, means for securing a plurality of said second clip means in spaced relationship to a face and along one marginal edge of said adjacent panel, said faces of said first and said adjacent panels facing towards said structural members, each said second clip means having a plate element secured in face to face relationship with said face of said adjacent panel, a resilient locking member projecting from each said plate element away from said adjacent panel and in a position to cooperate with cooperating means on the side of said one structural member remote from said one side, said adjacent panel having its said marginal edge overlying and its said face in face to face relationship with said projecting portion of said plate of said first clip means.

2. A system as defined in claim 1 wherein said first clip means further comprises a positioning flange projecting from said plate in substantially the opposite direction to said flange means, said positioning flange engaging said one edge of said panel.

3. A system as defined in claim 2 wherein said second clip means is provided with a positioning flange said positioning flange engaging with side edge of said adjacent panel at said margin.

4. A system as defined in claim 3 wherein there are two said positioning flanges on said second clip and wherein said positioning flanges on said second clip are connected to said second clip by a pair of arms positioned one on each side of said resilient locking member.

5. A system as defined in claim 2 wherein said first clip means has two of said positioning flanges one at each side of said first clip means.

6. A system as defined in claim 5 wherein said second clip means is provided with a pair of positioning flanges said positioning flanges engaging with side edge of said adjacent panel at said margin.

7. A system as defined in claim 6 wherein said positioning flanges on said second clip are connected to said second clip by a pair of arms positioned one on each side of said resilient locking member.

* * * * *